US012698121B2

(12) United States Patent
Muller et al.

(10) Patent No.: US 12,698,121 B2
(45) Date of Patent: Aug. 4, 2026

(54) ADJUSTABLE GROCERY BAG HOLDER

(71) Applicant: Roslyn J Muller, Boise, ID (US)

(72) Inventors: Roslyn J Muller, Boise, ID (US); Susan Lynn Latta, Boise, ID (US)

(73) Assignee: Roslyn Muller, Boise, ID (US)

( * ) Notice: Subject to any disclaimer, the term of this patent is extended or adjusted under 35 U.S.C. 154(b) by 49 days.

(21) Appl. No.: 19/001,401

(22) Filed: Dec. 24, 2024

(65) Prior Publication Data

US 2025/0320015 A1 Oct. 16, 2025

Related U.S. Application Data

(63) Continuation-in-part of application No. PCT/US2024/011100, filed on Jan. 10, 2024.

(60) Provisional application No. 63/462,496, filed on Apr. 27, 2023.

(51) Int. Cl.
*B65B 67/12* (2006.01)

(52) U.S. Cl.
CPC ..... *B65B 67/1227* (2013.01); *B65B 67/1233* (2013.01); *B65B 67/1238* (2013.01)

(58) Field of Classification Search
CPC ..... B65B 67/1227; B65B 67/1233; B65B 67/1238; B65B 67/12
USPC ..... 248/95, 99, 100, 97, 101
See application file for complete search history.

(56) References Cited

U.S. PATENT DOCUMENTS 1,350,443 A 8/1920 Edstrom
3,796,402 A * 3/1974 Trotta ..... B65B 67/12 248/101
4,576,310 A 3/1986 Isgar et al.
4,588,154 A 5/1986 Basore
4,750,695 A 6/1988 Greenhouse
4,759,519 A * 7/1988 Cheng ..... B65B 67/1238 D34/10
4,840,336 A 6/1989 Stroh et al.
(Continued)

FOREIGN PATENT DOCUMENTS

CN 202686887 U 1/2013
WO 2024226122 A1 10/2024

OTHER PUBLICATIONS

PCT International Search Report and the Written Opinion of the International Searching Authority, PCT/US24/11100, Applicant: Muller, Date of mailing: May 30, 2024.

*Primary Examiner* — Terrell L Mckinnon
*Assistant Examiner* — Michael McDuffie
(74) *Attorney, Agent, or Firm* — PEDERSEN & COMPANY, PLLC; Ken J. Pedersen; Barbara S. Pedersen

(57) ABSTRACT

An adjustable holder holds variously sized and shaped bags for holding purchases at a retail check-out or other goods-delivery station, to accommodate cloth or other non-uniform bags as an environmentally friendly, reusable substitute for plastic bags. The holder is adjustable in depth to closely fit the depth of the bag so that fasteners reach and hold-up and hold-open corners of the bag for maximum and reliable opening and positioning of the cloth/non-uniform bag throughout the bag-loading process. The holder may be also adjustable in width. The checker and shopper typically need not hold the bag open or even touch the bag during the bag-loading step. The full bag remains in an upright position in the holder until the checker or shopper disconnects the bag from the holder and grasps the handles of the bag to lift and carry away the filled bag.

25 Claims, 12 Drawing Sheets

(56) References Cited

U.S. PATENT DOCUMENTS 4,930,735 A 6/1990 Lax
4,934,636 A * 6/1990 Orlosky ..... B65B 67/12 248/95
5,238,139 A * 8/1993 Bisceglia ..... B65F 1/067 248/101
5,380,081 A 1/1995 Vogt
5,562,213 A 10/1996 Wile
D422,891 S 4/2000 Ohlman, II
6,152,408 A 11/2000 O'Grady
6,164,607 A * 12/2000 Hawkes ..... B65B 67/12 141/391
6,199,802 B1 * 3/2001 Scheibe, Sr. ..... B65F 1/1415 248/101
6,267,334 B1 7/2001 Siu
6,419,193 B1 * 7/2002 Rodriquez ..... B62B 3/106 248/101
6,517,033 B2 2/2003 Russell et al.
6,715,260 B1 4/2004 Dematteis
6,726,156 B1 4/2004 Scola
7,210,659 B2 * 5/2007 Lawson ..... D06F 95/004 211/94.01
7,284,732 B1 * 10/2007 Lopa ..... B65F 1/1415 248/101
8,028,380 B2 * 10/2011 Lin ..... B65F 1/06 248/101
8,109,477 B1 * 2/2012 Blasbalg ..... B65F 1/004 248/101
8,540,195 B2 9/2013 Astwood
9,033,291 B2 5/2015 Branham et al.
9,844,283 B2 * 12/2017 Bacallao ..... B65B 67/1238
11,447,333 B2 9/2022 Kuhl et al.
11,851,231 B2 * 12/2023 Bahr ..... A47B 77/18
2002/0100845 A1 * 8/2002 Green ..... B65B 67/12 248/101
2006/0175475 A1 * 8/2006 Desantis ..... B65F 1/1415 248/99
2011/0233348 A1 * 9/2011 Andersen ..... B65F 1/1415 248/97
2014/0217247 A1 * 8/2014 Kemmer ..... B65B 67/1205 248/97
2016/0304276 A1 * 10/2016 Castro ..... B65D 33/001
2017/0172322 A1 6/2017 Bacallao
2022/0233001 A1 7/2022 Short et al.

* cited by examiner

ADJUSTABLE GROCERY BAG HOLDER

This application claims priority and benefit of U.S. Provisional Application 63/462,496 filed Apr. 27, 2023 and is a continuation-in-part of PCT Application PCT/US2024/11100 filed Jan. 10, 2024, both applications being titled "Adjustable Grocery Bag Holder" and wherein the entire disclosures of both applications are incorporated herein by this reference.

FIELD OF THE INVENTION

The invented technology relates to a holder device for holding environmentally friendly and reusable grocery or other shopping bags at a check-out station. More specifically, the invented technology relates to a holder that may be adjusted to fit and support a great variety of shopping bags, for example, bags of various shapes, sizes, and materials, for hands-free holding in an open condition, allowing speedier, two-hand loading of purchased items by the shopper or check-out clerk. The holder is beneficial for shoppers or shops that want to use reusable shopping bags for filling by the shopper or check-out clerk, thus saving the cost of disposable/one-use bags, and especially reducing the environmental impact of plastic bags, which are typically not recyclable.

RELATED ART

Conventional bag holders at consumer retail check-out stations are metal frames fixed to one or more of the surrounding surfaces. These conventional bag holders are designed to hold plastic bags of uniform size and are not adjustable in size or shape. A large number of the plastic bags are typically detachably connected at a rear region at their upper edge(s) to form a stack. The stack of plastic bags is hung by placing the handle portions of the stack on protruding arms of the conventional metal frame, and the rear region of the stack is hung on a back central, upwardly extending protrusion of the frame. This way, the shopper or checker can grasp the front top edge of the frontmost bag and pull it to open the frontmost plastic bag for filling. Then, when the bag is filled with a desired amount of retail items, the handles of that filled bag may be grasped and pulled forward so that the filled bag separates at its rear upper edge from the other bags, freeing that bag to be carried away by the purchaser. This conventional system is particularly useful for detachable plastic bags all made the same size and shape and formed into said stack that is specially made to cooperate with the non-adjustable frame (hereafter "uniform plastic bags" or "bag-stacks").

When a shopper wants to use his/her cloth bag or other non-uniform bag, the shopper or checkout-clerk (or "checker") must typically use both hands throughout handling and filling of the bag. For example, the checker places the non-uniform bag, unsupported by any frame or structure, on top of the check-out counter opens the bag with two hands and holds the bag open with one hand while inserting items into the bag opening with the other hand. The size and shape of the surrounding bagging surfaces may vary greatly. Further, cloth and other non-uniform bags vary greatly in size and shape, so the checker needs to manipulate each non-uniform bag to try to get it in a convenient position for filling and then typically has to do extra work to hold the bag open while stuffing and/or arranging each item inside the bag. In summary, use of non-conventional bags is currently inconvenient for both the checker and the shopper. Currently, the inconvenience of using a bag other than conventional plastic bags from the bag stack provided by the store tends to result in many shoppers defaulting to plastic bags instead of environmentally friendly cloth or other reusable bag options they may prefer. Objects of the invention include eliminating this inconvenience and/or allowing a reusable, non-plastic bag option for environmentally conscious shops and shoppers/customers.

SUMMARY

The invented apparatus and/or methods may comprise providing a holder at a check-out station for holding a variety of reusable non-uniform bags for holding retail purchases. The holder is adapted in depth and/or width to hold bags of various sizes and shapes, so that a shopper/customer is encouraged to bring his/her own cloth, canvas, or other more environmentally friendly bag. In certain embodiments, the holder is also adapted to adjust to fit various bagging surfaces. By using the invented holder, the checker may grasp the bag and install it in a convenient location and position typically below the level of the top surface of the check-out station, in a location similar or the same as a conventionally installed plastic bag stack holder.

The holder apparatus and method are simple and effective and can removably connect to and support bags of various sizes and shapes, including but not limited to, rectangular or oval bags. The apparatus and method are adapted to clasp/removably-connect to the upper perimeter that defines the opening of the non-uniform bag (hereafter, "bag opening"), and the apparatus may thereby hold the bag upright and open during the bag-loading process. This way, after the bag-placement step of inserting the bag within the holder and the bag-connection step of clasping/connecting the bag upper perimeter to the holder, the checker typically does not need to hold the bag open or in an upstanding position, or even touch the bag, during the bag-loading step. Thus, whether the bag is large or small in width and/or depth, tall or short, or shallow, square, round, or oval, the checker is not frustrated by having to constantly hold and jostle the bag to load it. The full bag remains in an upright position in the holder at least until the checker or shopper disconnects the filled bag from the holder and preferably until the checker or shopper lifts/pulls the filled bag up/away from the holder.

To simply and effectively accommodate bags of various sizes and shapes, certain embodiments of the holder comprise an adjustable frame and clips or other fasteners that are adjustable in position on the frame. Preferably, the frame is adapted to be adjustable in front-to-back depth to fit the depth of the bag being used and its bag opening, so that the clips or other fasteners on the frame will reach and reliably capture the bag perimeter to keep it open during loading. To accommodate bags of various widths, certain embodiments of the frame are also or instead adapted to be adjustable in left-to-right width to fit the width of the bag being used and its bag opening, or to be at least as wide as said bag and opening, and so that clips or other fasteners can be moved toward the left and/or right to reach and reliably capture the open bag perimeter near the bag left and right sides during loading, for example, at front and rear perimeter corners near the left side and the right side of the open bag. The preferred combination of both depth and width adjustment allows the frame interior space to closely fit the depth of the bag, and be at least as wide as the bag, so that clips or other fasteners reach and hold-up and hold-open corners of the bag for maximum and reliable opening and positioning of the cloth/non-uniform bag throughout the bag-loading process.

DETAILED DESCRIPTION OF CERTAIN EMBODIMENTS

Figure 1:
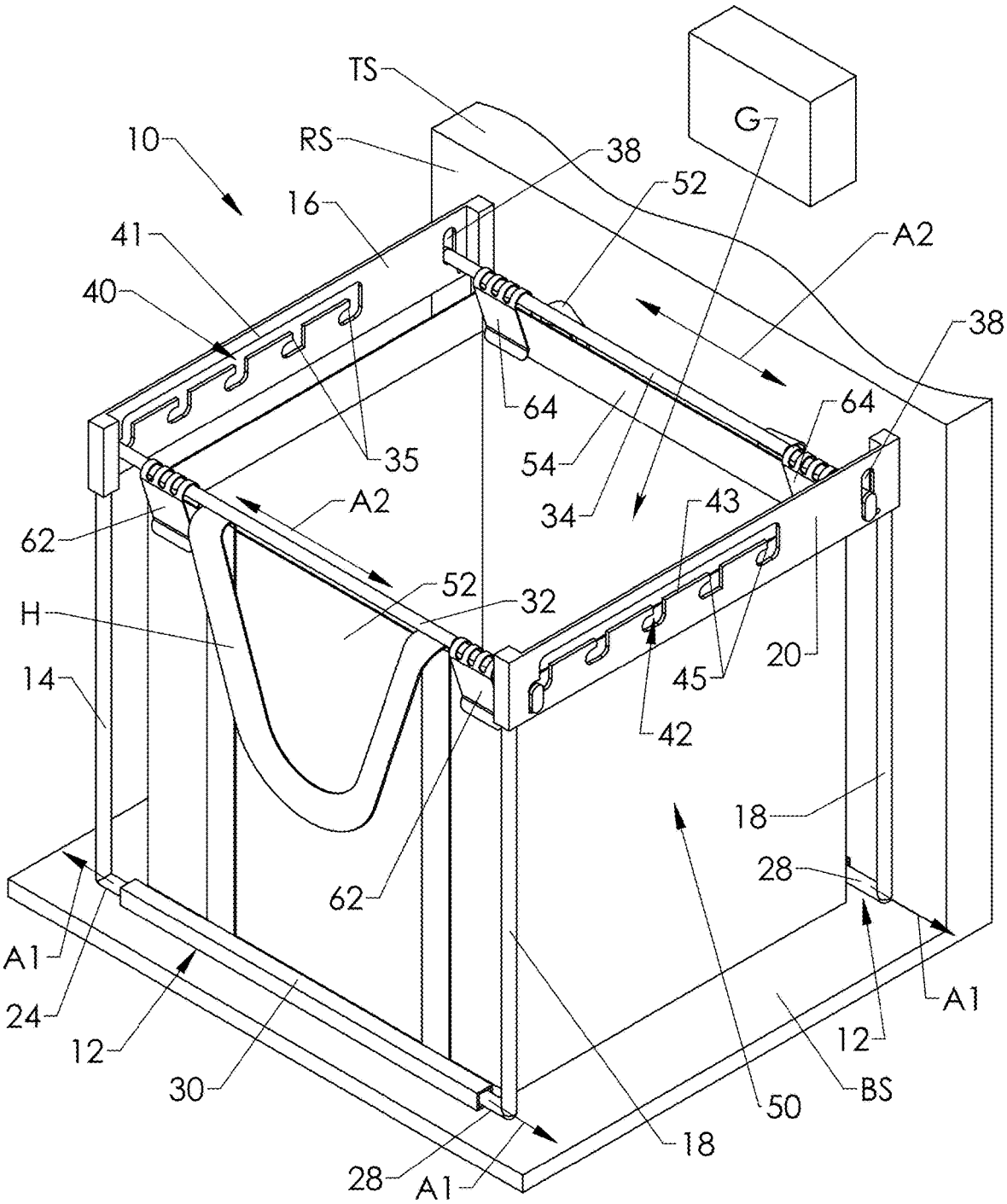
FIG. 1 is a top, front-right perspective view of one embodiment of the invented bag holder in use in an exemplary bagging alcove in a retail store or other location where a bag is to be filled with objects.

The Drawings show some, but not the only, embodiments of the invented apparatus and methods of using the apparatus. The invented apparatus and methods provide an adjustable holder for holding bags of various dimensions and sizes, so that a shopper's own cloth or other reusable non-uniform bag may be used at the check-out station of a store, or at other locations where a bag is to be filled with objects for carrying away. The holder and methods encourage use of reusable bags instead of plastic bags, to help save the environment from massive amounts of plastic litter and landfill. In certain embodiments, the holder comprises a rectangular frame, and at least one clip or other fastener, and preferably multiple clips or other fasteners, provided on the frame for connecting a shopping bag to the frame. In certain embodiments, the frame is made of multiple elongated members, certain of which are slidable or otherwise moveable relative to each other, for adjustment of the dimensions of the frame and therefore of the interior space inside the frame. The frame is substantially open, that is, substantially open at its front, right, and left sides, and preferably also at its rear side. This openness enhances efficiency of frame handling and adjustment, installation of the bag in the interior space, viewing and access to the bag during filling of the bag, and removal of the bag upon completion of said filling. It may be noted that the frame forms the main structure of the embodiments shown in the drawings, and, therefore, in certain embodiments, the interior space of the frame may also or instead be described as the interior space of the holder, the top opening of the frame may also or instead be described as the top opening of the interior space and/or of the holder, and the open sides of the frame, further described later in this document, may also or instead be described as the holder's open sides.

The interior space is adjustable in depth, preferably by adjusting the distance between the frame's bag-carrying members. In certain embodiments, the interior space is also adjustable in width, preferably by the left and right portions/sides of the frame being moveable toward and away from each other. Thus, bags ranging from very small to large may be quickly accommodated at the check-out station. In this document, depth of the holder, frame, and bag are defined as the horizontal, front-to-rear dimension (or "front-to-back" dimension). In this document, width of the holder, frame, and bag are defined as a horizontal, right-to-left dimension, because a user may stand in front of the holder, facing the holder and bag with the user's right arm near the right of the holder and bag and the user's left arm near the left of the holder and bag. In this document, the height of the holder, frame, and bag are defined as the vertical, top-to-bottom dimension.

The holder further comprises at least one clip or other fastener, and preferably multiple clips or other fasteners that are shaped and sized to extend downward into the top opening of the interior space of the frame to grasp or otherwise removably connect to the upper perimeter of the bag and thereby to hold the bag upright and open prior to and during loading of the bag. This way, once installed in, and clipped to, the frame, the checker need not touch or manipulate the bag until the bag is unclipped/disconnected and carried away from the check-out stand. In certain embodiments, each of two opposing upper edges of the bag upper perimeter is grasped/connected to the frame by at least one clip/fastener. In certain embodiments, each of the front and rear upper edges of the bag is grasped/connected to the frame by at least two clips/fasteners, so that at least the right and left ends/extremities (or "corners") of the front and rear upper edges are grasped and held-up to be close to the top side of the frame.

Figure 2:
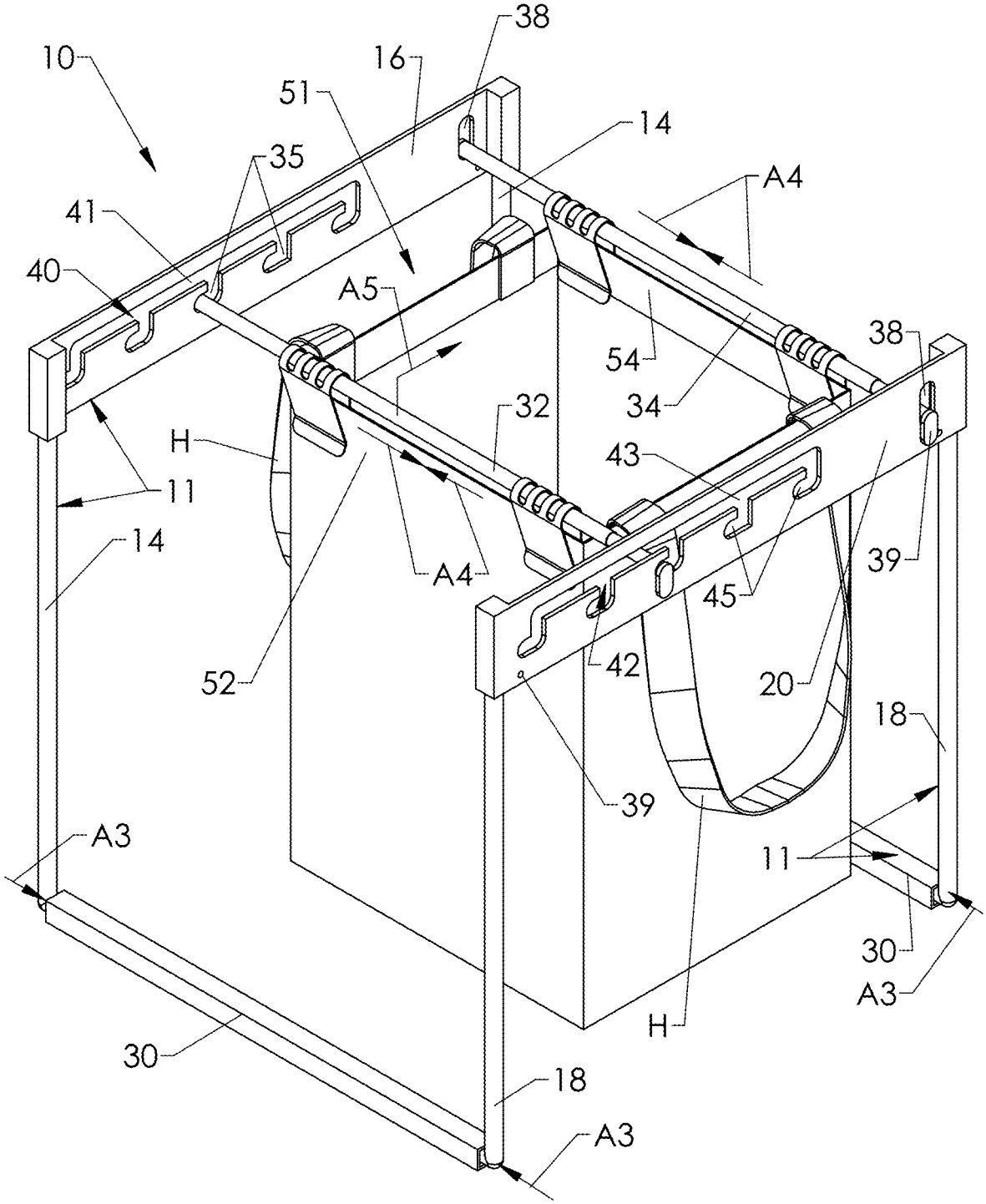
FIG. 2 is a top, front-right perspective view of the holder of FIG. 1, wherein the holder's frame has been adjusted to receive and hold a bag that is of the same general shape as that in FIG. 1 but smaller in both width and depth and rotated 90 degrees. While not shown in FIGS. 2-8, a bagging alcove or other supporting surface/structure for the holder in FIGS. 2-8 will be understood from FIG. 1 and the Detailed Description of this document.

Referring Specifically to the Drawings and Reference Numbers/Letters:

In FIGS. 1-6, an embodiment of the invented holder 10 comprises an apparatus assembly comprising frame (referenced as 11 in FIGS. 2, 3, 3A, and 4) and clips 62, 64. In FIG. 1, the holder 10 holds a medium-sized, square-bag-opening canvas/cloth (hereafter "cloth") bag 50, wherein the upper edges of the front side and the rear side of the bag are clasped by flexible and resilient clips 62, 64, to reliably hold the bag upright and open for filling, and wherein the bag handles H extend down at/near the front and rear sides of the bag and the holder 10. As the handles are not used in most embodiments for capture or support of the bag in the holder, the bag alternatively may be rotated, for example, 90 degrees. For example, in FIGS. 2 and 7, bag 51 is installed in the holder with the handles H extending down at/near the right and left sides of the bag and holder. This flexibility in bag and handle positioning options may provide additional room or alternative positions for placement of the bag in the interior space IS and/or for clip-capture of the bag perimeter. For convenience, interior space IS is called-out in FIGS. 3-5 that show no bag, but the viewer will understand that FIGS. 1 and 2 show bags 50 and 51 having been inserted into the holder's interior space prior to clipping the top edges.

In FIG. 1, holder 10 rests in an alcove at or near the location where the conventional plastic-bag holder is typically installed. The alcove is portrayed in FIG. 1 as comprising the bagging surface BS and a rear surface RS. The holder 10 bottom end, formed in this embodiment by two bottom rungs 12, may rest on the bagging surface BS, for example, at a lower level than the top surface TS of the checker's scanning table/station. In certain embodiments, the holder 10 is not fixed to the bagging surface BS, the rear surface RS, or any surface, but is rigid enough to keep its shape when resting on the bagging surface BS even when the bag 50 has been filled with goods G. Alternatively, in certain embodiments, the holder 10 may be connected/anchored to the alcove for increased security and convenience of use, for example, by bolts or other screws through holes, in anchor bracket 16 and/or bracket 20, that connect to surface(s) of the bagging alcove. In FIG. 2, two holes 39 in bracket 20 are visible, and, in FIGS. 3 and 3A, two holes 37 in bracket 16 are visible. In certain embodiments, if desired, other hole and bolt/screw locations may be used or other connections extending from portion(s) of the holder 10 to portion(s) of a bagging alcove, in such way(s) as to not interfere with adjustment of the width (right to left) of the frame 11, or with adjustment of the front crossbar of the frame 11.

Prior to and/or upon insertion of the bag 50 into the holder 10, the user (checker, or optionally the shopper) may adjust the frame 11 for a good fit of frame to bag. Width adjustment may include changing the distance between the right and left sides of the frame, by telescoping of the bottom rungs 12, which typically also pulls outward on the ends of the crossbars 32, 34 to change the length of the preferably-telescoping, top crossbars 32, 34, to make the interior space IS at least as wide as the width of the bag 50 to be held. Preferably, this width adjustment changes the width of the interior space IS of the frame 11 to be the same as, or up to 20 percent, or more preferably up to 15 percent greater than, the width of the bag 50 to be held.

In FIG. 1, arrow A1 schematically illustrates how the vertical right and left frame portions have been telescoped out a short distance by outward telescoping of the rungs 12 (horizontal members 24, 28 slidably received in front and rear central tubes 30), and arrow A2 schematically illustrates how the right and left portions of the crossbars 32, 34 have been telescoped out a short distance. Note that the clips 62 are at the front edge of the bag opening perimeter near the left side and the right sides of the open bag and so may be described as being at "front corners" of the open bag. Clips 64 are at the rear edge of the bag opening perimeter near the left side and the right sides of the open bag and so may be described as being at "rear corners" of the open bag.

In FIG. 2 (with bag installed) and 3 (with bag removed), holder 10 has been adjusted to fit a smaller bag 51, by width adjustment, and also by depth adjustment via changing the distance between the two crossbars to which the bag upper edges are clipped/fastened, to make the depth of the interior space IS at least as deep as the depth of the bag 51 to be held. In FIG. 3A, frame 11 is shown by itself, that is, with clips 62, 64 removed. Preferably, this depth adjustment changes the interior space depth to be the same as, or up to 20 percent, or more preferably up to 15 percent greater than, the depth of the bag 51 to be held. Specifically, in FIG. 2, the width of the frame and the interior space have been reduced slightly compared to FIG. 1 by inward telescoping of bottom rungs (arrow A3 in FIG. 2) and by inward telescoping of both the crossbars (arrow A4 in FIG. 2). Also, the depth of the interior space has been reduced by moving the front crossbar 32 horizontally about halfway to the rear crossbar 34, which is accomplished by lifting the crossbar 32 from notches 35, 45, and sliding it along the horizontally-elongated portions 41, 43 of the adjustment-slots 40, 42 (see curved arrow A5 in FIG. 2). Therefore, the interior space in FIG. 2 is adjusted to receive and hold a bag that is the same general shape as that in FIG. 1 but smaller in both width and depth.

It may be noted that the frame is preferably made to have a maximum depth that is as large as the greatest depth of bags to be used and/or as large as the greatest depth of the bagging surface on which the holder will be installed. Depth adjustment of the holder from said maximum depth to smaller depths is preferred in order to place the clips/fasteners relative to the upper edges of smaller bags in locations/positions effective for easy capture and support of the bag upper edges in said clips/fasteners. For example, the effective locations/positions for the clips/fasteners are directly above or within about 2 inches of being directly above the upper edges when the bag is fully open. Similarly, it may be noted that the frame is preferably made to have a maximum width that is as large as the greatest width of bags to be used and/or as large as the greatest width of the bagging surface on which the holder will be installed. Width adjustment to lessen the frame width may not be required for all holders and/or all uses, especially in embodiments wherein the clips/fasteners are only provided on the front and rear of the frame, but adapting the frame for width adjustment is preferred in most embodiments so the frame can be adjusted to fit various bagging surfaces and/or user preferences. Certain users will choose to keep the frame at its maximum width, or at the greatest width that fits on the bagging surface, to give them more room for inserting the empty bag and/or for removing the loaded bag from the frame.

Due to its smaller width, bag 51 has been rotated 90 degrees relative to the bag in FIG. 1 to place the bag handles toward the right and left sides of the holder 10, leaving more room for clipping bag 51 to the crossbars. Further, clips 62, 64 have been moved closer to each other than in FIG. 1 (arrow A6 in FIG. 3), but are still at front and rear corners, near the left side and the right side, of the open bag. FIG. 4 shows adjustment of the front crossbar relative to the front and rear sides of the frame 11 by sliding the crossbar forward and rearward through horizontally elongated portions 41, 43 of the adjustment-slots 40, 42 (arrow A7).

Figure 3:
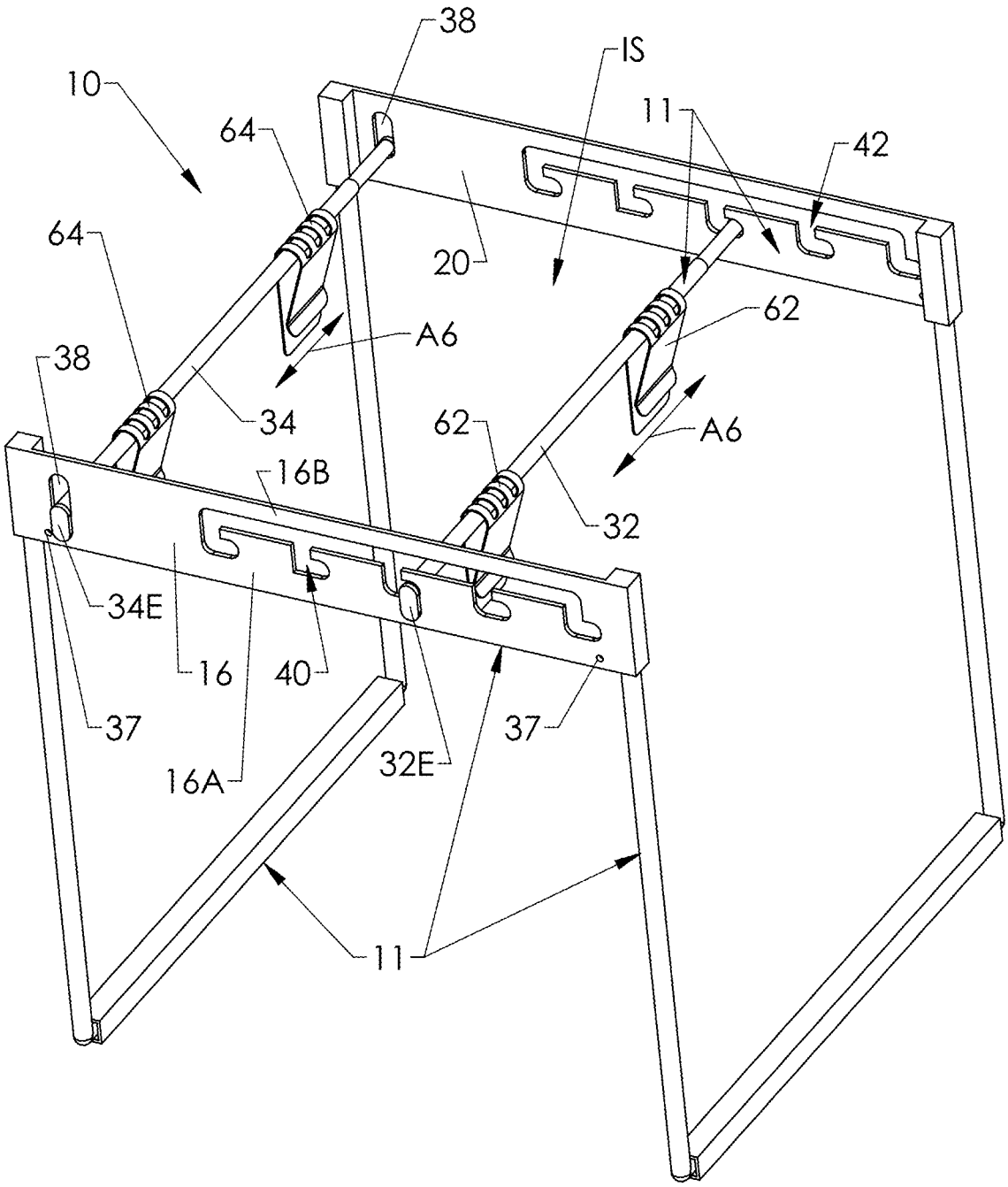
FIG. 3 is a top, left side perspective view of the holder of FIG. 1, adjusted as in FIG. 2 and with the bag removed, illustrating with arrows that the clips on the crossbars are slidable along the crossbars.
Figure 3A:
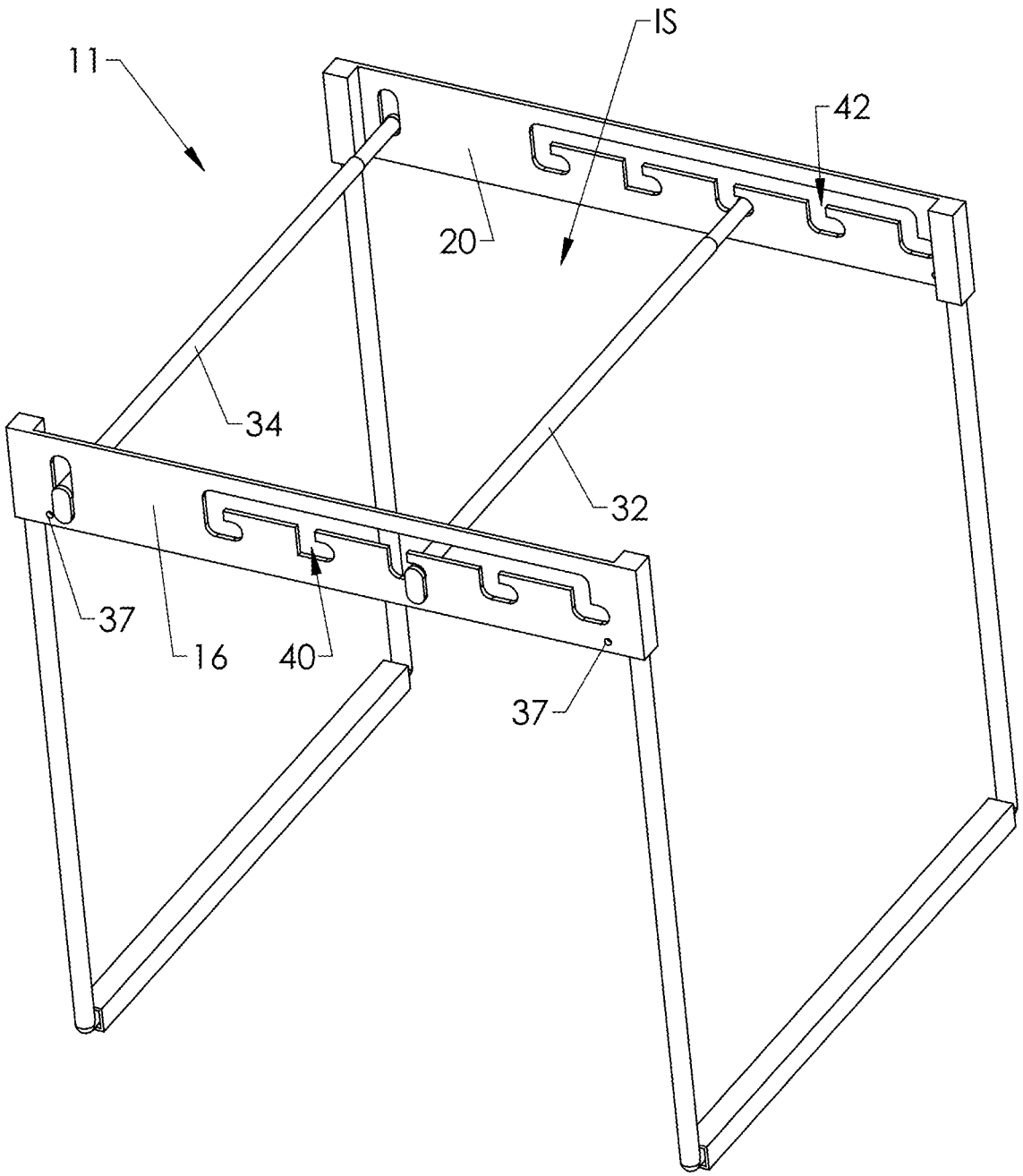
FIG. 3A is the view of FIG. 3, with clips removed to show only the frame.
Figure 4:
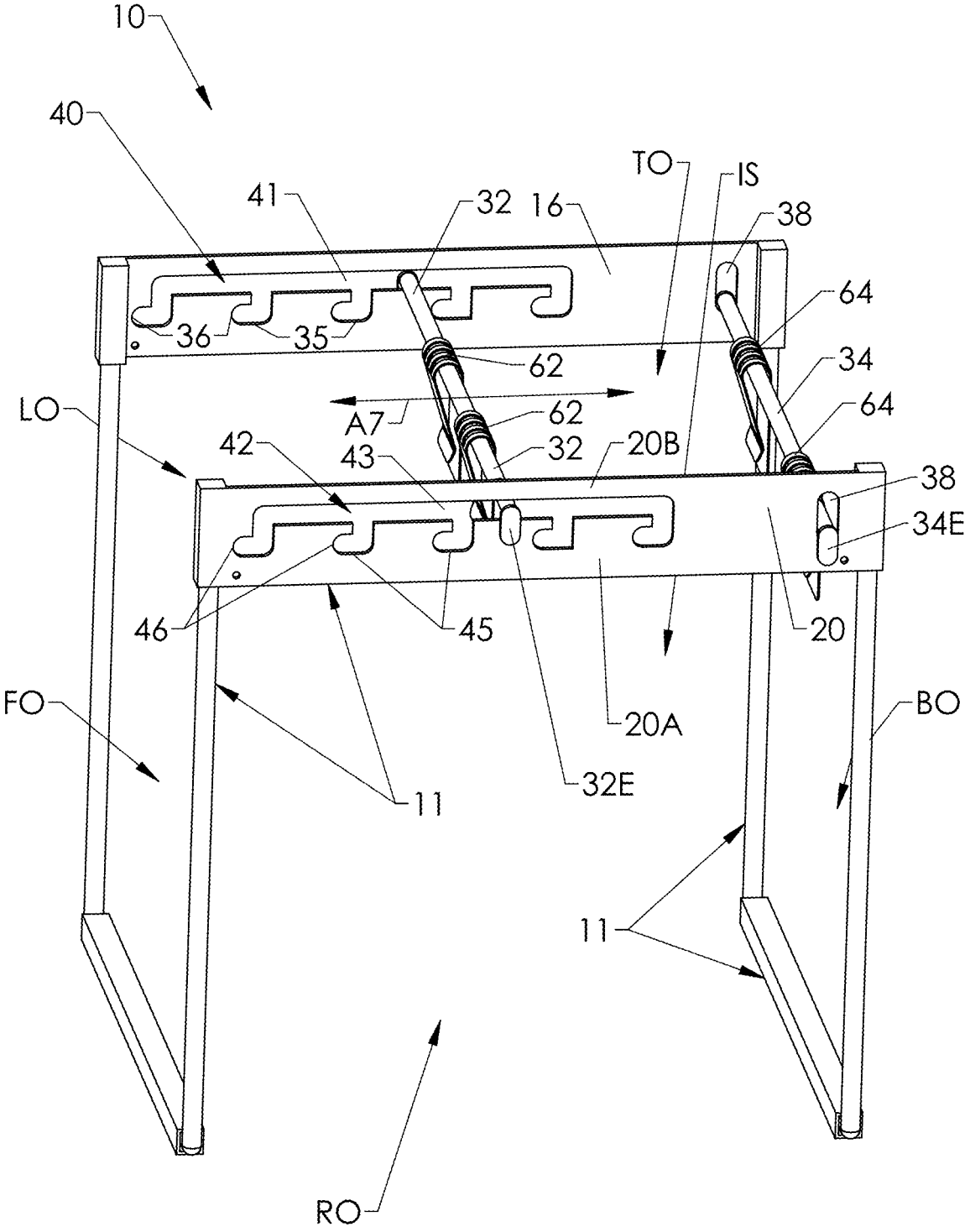
FIG. 4 is a right-side perspective view of the holder of FIG. 1, adjusted as in FIGS. 2 and 3 except that the front crossbar has been lifted up to be slidable frontward and rearward for adjustment of the distance between the crossbars.

Bracket portions 16A and B, pointed out in FIG. 3, extend under and above the adjustment-slot 40, respectively, so the slot 40 may be described as extending right-to-left through the slot 40 but being closed at the slot 40 top and bottom. This way, the crossbar 32 may be inserted through the slot 40 in the right-left width direction, but, given the closed slot bottom formed by portion 16A and the closed slot top formed by portion 16B, the crossbar may not be removed from the frame by dropping the crossbar 32 directly down, or lifting the crossbar 32 directly up, from the slot 40. Likewise, bracket portions 20A and B, pointed out in FIG. 4, extend under and above the adjustment-slot 41, respectively, so the slot 41 may be described as extending right-to-left through the slot 41 and being closed at the slot 41 top and bottom. This way, the crossbar 32 may be inserted through the slot 41 in the right-left width direction, but, given the closed slot bottom formed by portion 20A and the closed slot top formed by portion 20B, the crossbar may not be removed from the frame by dropping the crossbar 32 directly down, or lifting the crossbar 32 directly up, from the slot 41. Instead, for removal of the crossbar 32 from the brackets 16 and 20, the crossbar 32 is moved to notches 35, 45, with the crossbar 32 rotated to place the crossbar ends 32E vertical (see FIGS. 3 and 4), whereafter the crossbar ends 32E be lifted slightly and slid left or right out of the notches 35, 45 in bracket 16 and 20, respectively.

For adjusting the front crossbar 32, when the front crossbar 32 reaches the desired distance from the rear crossbar 34, crossbar 32 is then dropped down, so that the crossbar ends 32E enter notches 35, 45, and the left and right ends 32E are retained in the notches 35, 45 due to the ends 32E extending down along the outer sides of the left and right brackets 16, 20 respectively. Once the bag-filing has begun, the weight and volume of the objects placed in the bag may tend to pull the bag's forward wall slightly down and/or forward, so the crossbar 32 will tend to stay in the selected notches, for example, even in the forward-most ends 36, 46 of the selected notches. The crossbar system is further described later in this document.

Figure 5:
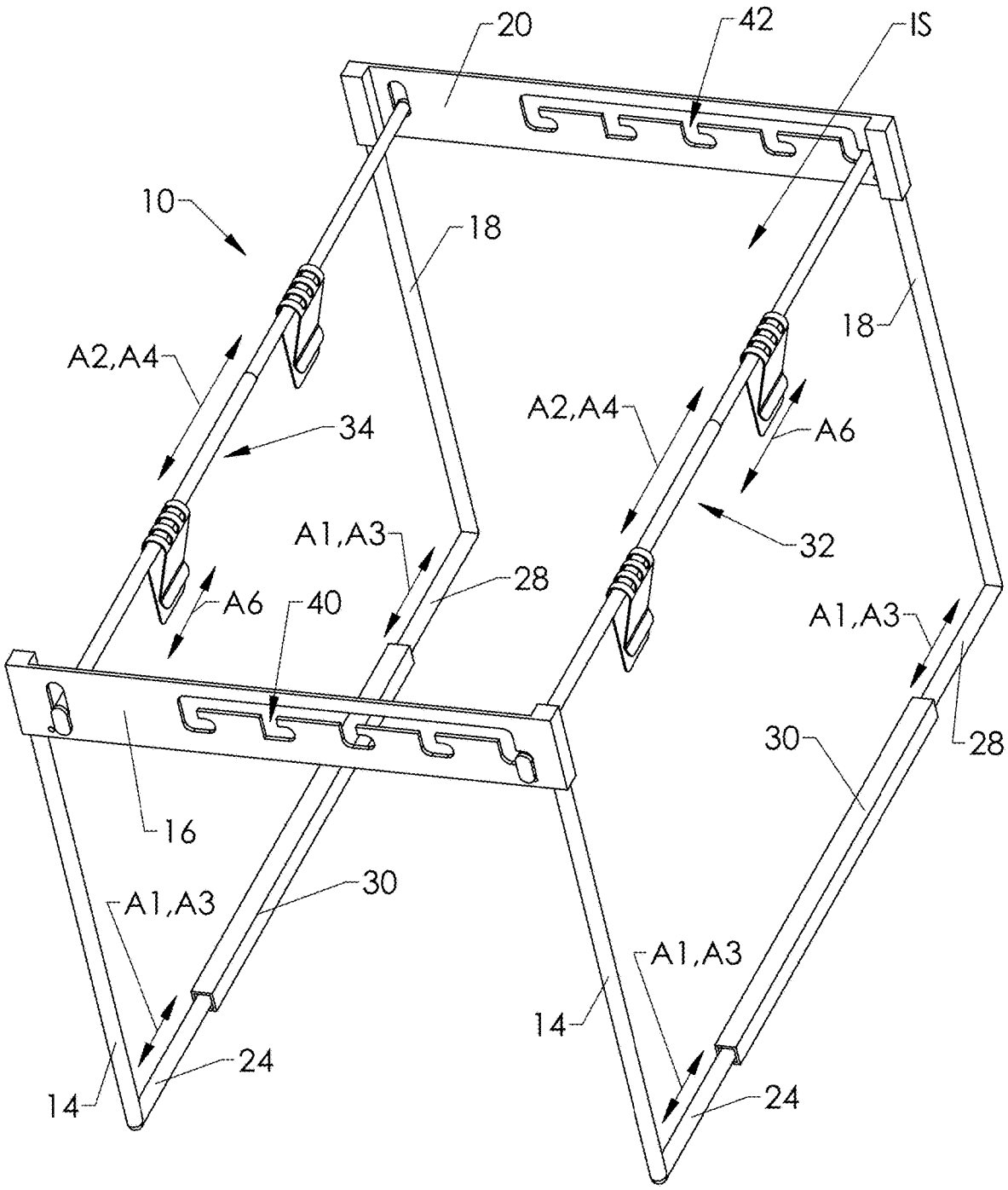
FIG. 5 is a top, left side perspective view of the holder of FIG. 1, with bag removed, wherein arrows illustrate that the holder including the crossbars may be telescoped to a significantly greater width than in FIG. 1 and arrows illustrate sliding of the clips on the crossbars.

FIG. 5 shows width adjustment of the frame and location adjustment of the clip on the crossbars of the frame. Outward and inward adjustment of the left and right sides of the frame is portrayed by arrows "A1, A3". Outward and inward adjustment of the crossbar length is portrayed by arrows "A2, A4", to match/accommodate the width adjustment of left and right sides of the frame. Adjustment of clips along the crossbars is portrayed by arrows "A6", as needed or desired for a particular bag to place the clips preferably at or near the front and rear corners of the open bag perimeter.

Therefore, adjustment of the holder 10 and therefore the interior space IS allows the holder 10 to receive and hold a medium-sized bag 50 (FIG. 1) or a small-sized bag 51 (FIG. 2), or even a large-size bag (not shown) that is larger in width (right to left) and/or depth (front to rear) than the bag in FIG. 1. To accommodate the larger bag, the frame left and right sides may be telescoped to a larger width than in FIG. 1 to maximize the frame width, as will be understood from FIGS. 4 and 5, and the crossbar 32 may be moved to its position farthest from crossbar 34 to maximize the frame and interior space depth, as understood from FIGS. 1, 4 and 5. The large bag may be positioned/rotated in the interior space IS so that it best fits within the IS, and, if the bag is larger than the maximum interior space IS of the bag (after adjusting the frame to maximum width and depth), a portion of a wall of the bag optionally may be folded or pushed slightly through an open side of the frame as long as the bag and its contents remain liftable up out of the frame after the bag is filled.

As shown in FIG. 4, the front, left and right sides of the frame 11, and therefore of the holder 10, are substantially open, that is, the left side opening LO, the right side opening RO, and the front opening FO preferably each amount to at least 80 percent, of the area of the left, right, and front side areas of the frame The rear (back) opening BO is preferably also at least 80 percent of the area of the rear side of the framer but may be optional in certain embodiments.

Figure 6:
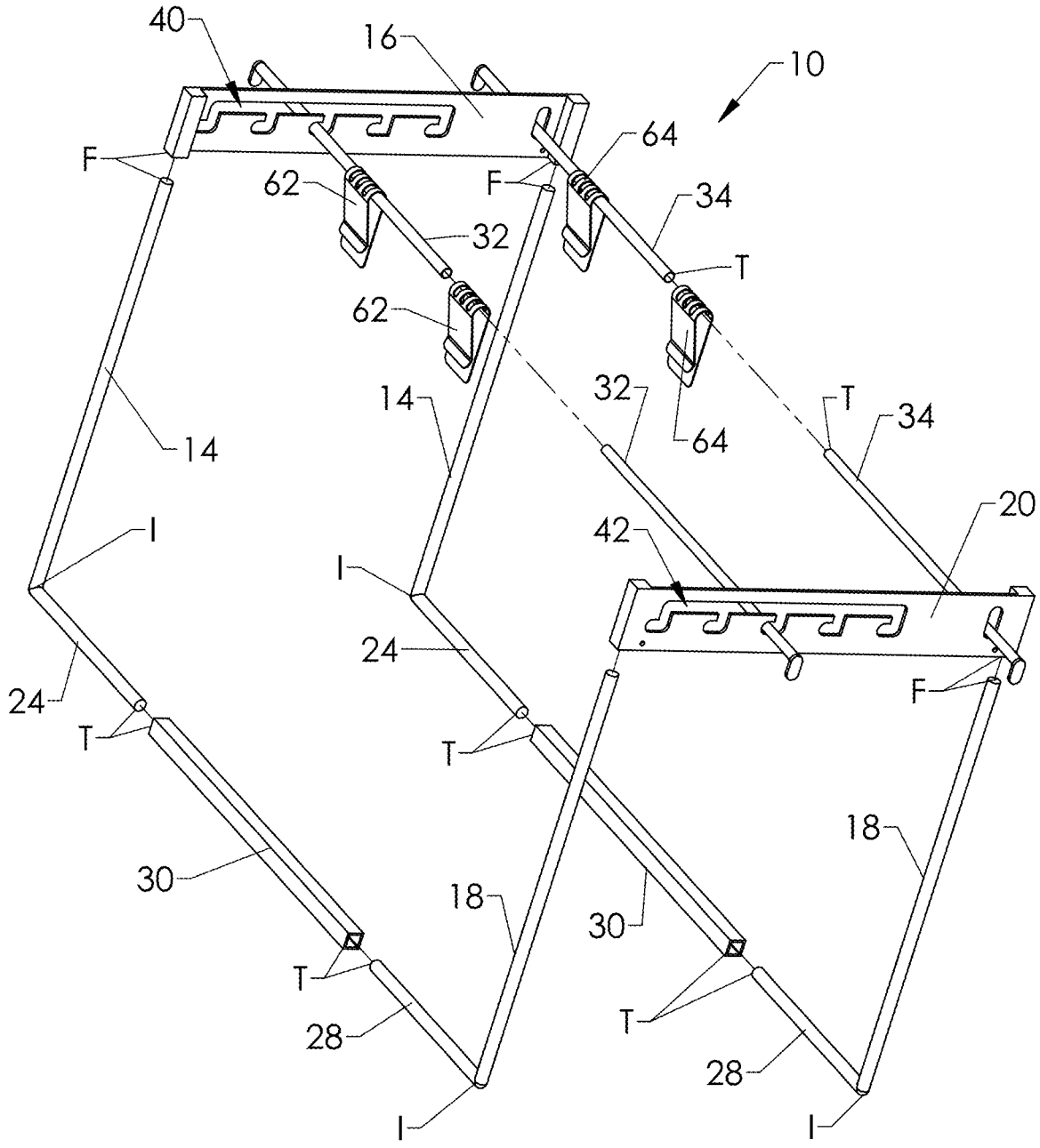
FIG. 6 is an exploded front-right perspective view of the holder of FIG. 1, with bag removed and front crossbar in a position as in FIGS. 2 and 3.

Referring to FIGS. 5 and 6, the "left side" of holder 10 and its frame, may be described as comprising the left vertical side members 14 and the left upper bracket 16 that is fastened/fixed to the side members 14. Also, the "right side" of the holder 10 and its frame, may be described as comprising right vertical side members 18 and the right upper bracket 20 that is fastened/fixed to the side members 18. The left and right vertical side members 14, 18 are preferably integral with or fixed to horizontal members 24, 28, respectively, that telescope in and out from the front and rear central tubes 30. The central tubes 30 are square in cross-section to help holder 10 rest stably on the bagging surface BS, but the central tubes may be alternative shapes in certain other embodiments. In the exploded view of FIG. 6, portions of elements that are preferably integrally connected are marked I, ends/portions of elements that are fastened/fixed together are marked F, and ends/portions of elements that are movable/telescoping relative to each other are marked T. Crossbar 32 is slidable along, and droppable down into the notches 35, 45 of, the adjustment-slots 40, 42, as described above. Clips 62, 64 are preferably slidable along the entire or substantially the entire lengths of their respective crossbars, and rotatable at least 90 degrees, more preferably at least 120 degrees, and most preferably at least 180 degrees, around their respective crossbars.

It may be noted that brackets 16, 20 are described above as "fastened/fixed" to side members 14 and side members 18, respectively, and that may include various connections, temporary or otherwise, between the brackets and their respective side members. In certain embodiments, the "fastened" may be firm and secure, to prevent the connected parts from easily connecting apart during use, or may be relatively easy to purposely disconnect, for example, as desired by a user when trying to get a particular bulky or heavy loaded bag out of the holder or for easy disassembly of the holder for moving and reinstalling in a different location. In certain embodiments, the "fixed" versions may be permanent or semi-permanent, to make the holder very sturdy and incapable of, or very unlikely to, come apart during use. In certain embodiments, members 24 and 28, which preferably telescope relative to central tubes 30, are shown to be cylindrical/tubular and may be sized to rotate easily in the central tubes 30. This may be beneficial for manufacture and for smooth width adjustment, for example, but other relative shapes may be used for some embodiments. In certain embodiments, it may be desirable to make members 24 and 28 not rotatable, or unlikely to rotate, inside the tubes 30, for example, to keep side members 14 and/or 18 from rotating to fall down to the bagging surface by rotating in the tubes 30 if a side member 14 and/or 18 are accidentally or purposely disconnected from bracket 16 or 20.

In the embodiments shown in the Figures, no width-adjustment locking mechanism is added, except that the friction between telescoping members tends to keep the frame in its width-adjusted position, especially in view of the weight of items being bagged tending to keep the frame in its adjusted position. This lack of width-adjustment locking mechanism, except for said friction, may be beneficial for the sake of simplicity, but, in certain embodiments, additional locking mechanism(s) may be added to lock the frame in one or more adjusted widths, if desired.

Referring More Specifically to the Crossbar System:

In FIGS. 1-6, one may see front and rear crossbars 32, 34 (also hereafter and in the claims "bars") extend between brackets 16 and 20 to form upper supports for the top of the bag 50, 51. As shown in FIGS. 3 and 4 and described above in this document, the front crossbar 32 is captured, but movable and adjustable, with its two ends 32E in notches 35, 45 of left and right adjustment-slots 40, 42 of the brackets 16, 20, respectively. The rear crossbar 34 is similarly captured at its two ends 34E in left and right vertical slots 38 in the brackets 16, 20. The crossbars 32, 34, after insertion of the ends 32E, 34E right-left into the notches 35, 45 or vertical slots 38, respectively, tends to fall downward by their own weight so the ends 32E, 34E extend down along the outer sides of the left and right brackets 16, 20, respectively. Further, the weight of a bag connected to the crossbars by clips or other fasteners, especially when being loaded, will tend to pull the crossbars 32, 34 down in the bracket slots 40, 42 and vertical slots 38, respectively. The crossbars 32, 34 each comprise left and right crossbar portions that telescope relative to each other. Frame width adjustment may be accomplished by a combination of the left and right sides of the frame being moved farther or closer to each other via telescoping of members 24 and 28 relative to central tubes 30, wherein said moving farther or closer pulls outward or pushes inward, respectively, the ends of the crossbars 32, 34 to telescope the crossbars.

In FIGS. 1-6, each adjustment-slot 40, 42 has a horizontally-elongated portion 41, 43 in which the crossbar 32 may slide longitudinally along the length of the brackets 16, 20 (FIG. 4) and multiple notches 35, 45 extending vertically downward from, spaced-apart locations along portions 41, 43. For adjustment of the depth of the interior space, after sliding the front crossbar 32 along the horizontally-elongated portions 41, 43 (FIG. 4) to the desired distance from the rear crossbar 34, the ends of crossbar 32 are allowed to drop into selected notches 35, 45 to be retained from further sliding along portions 41, 43. This way, the front crossbar 32 may be adjusted by the checker or the shopper prior to or in conjunction with installation of the bag 50, 51 in the holder 10, but before loading the bag 50, 51, to adjust the effective depth (front to rear) of the interior space IS of the frame to accommodate different depths of the bag to be used with the holder 10, as discussed earlier in this document.

Referring More Specifically to Bag-Capture Clips:

Either after or in conjunction with frame depth adjustment, and in certain embodiments also width adjustment, the bag 50, 51 is placed in the interior space IS and the front and rear top edges 52, 54 of the bag 50, 51 are connected to the front and rear crossbars 32, 34, respectively. In FIGS. 1 and 2, this is done by inserting the front and rear top edges 52, 54 into clips 62 and 64, respectively. Note that the "front edge" and the "rear edge" of the bag are defined based on bag edges being placed near the front and rear of the frame, respectively, rather than based on the edges' locations relative to the handles. Clips 62, 64 may be slid along, and rotated on, the crossbars for ergonomic reasons and to capture the bag preferably near corners of the bag. For example, a checker or shopper may first grasp the rear top edge 54 in one hand and push it into one or more of the rear clips 64 held one-at-a time by the other hand, and then secondly grasp the front top edge 52 in one hand and push it into one or more of the front clips 62 held one-at-a-time by the other hand. This way, each of the top edges 52, 54 is held up near a respective crossbar 32, 34, for keeping the bag 50, 51 open and extended up to its full, or at least substantially its full, height. Clipping the rear top edge 54 before the front top edge 52 of the bag is expected to be convenient for a person standing at the front of the holder but the opposite (clipping the front top edge 52 before the rear top edge 54) may be done in certain embodiments and for certain user positions.

Figure 7:
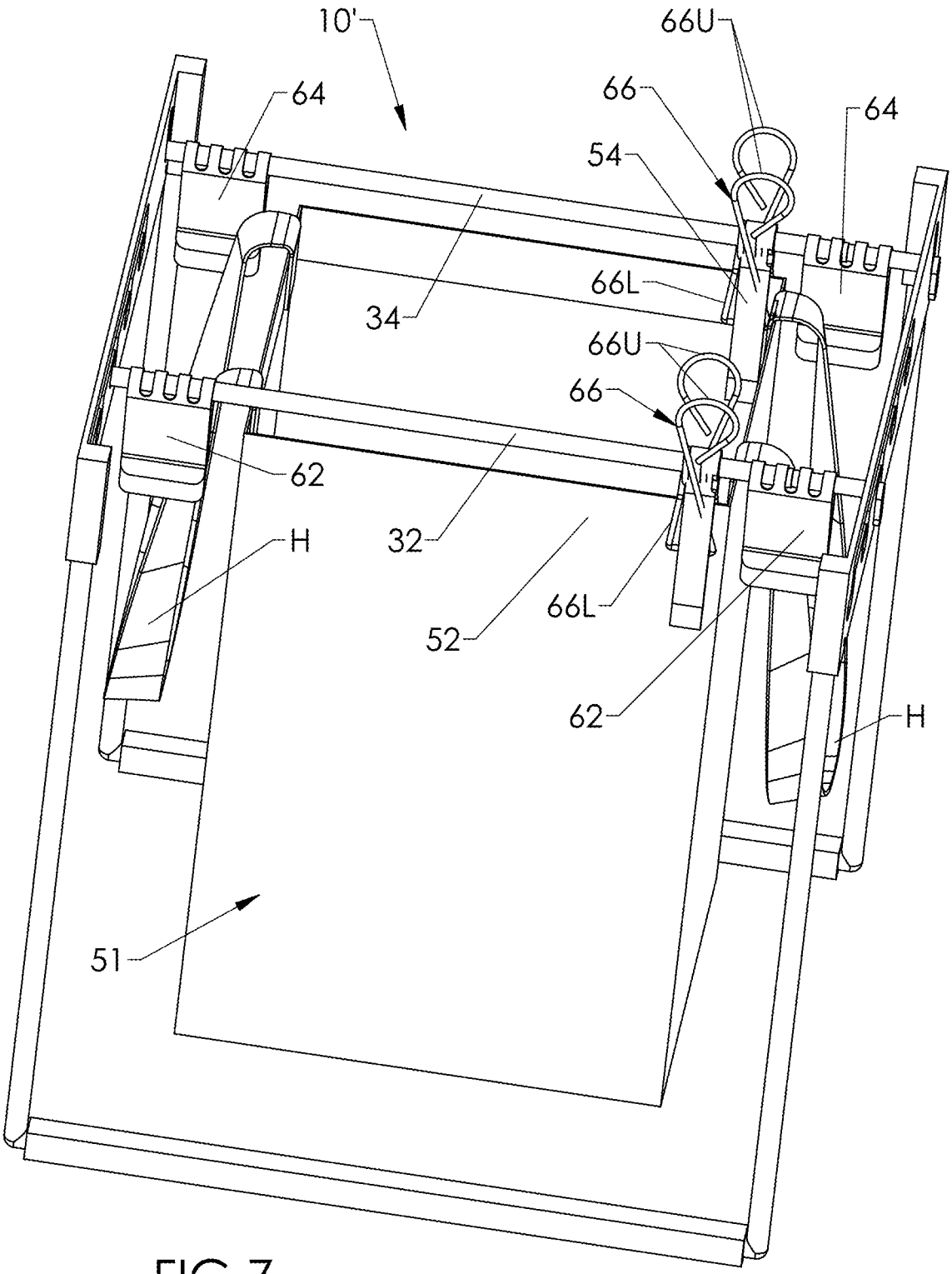
FIG. 7 is a top front perspective view of the holder of FIG. 1, with left and right sides and crossbars adjusted as in FIGS. 2 and 3, wherein the clips are slid away from the bag, but an alternative clip is added to each crossbar for grasping the bag perimeter.
Figure 8:
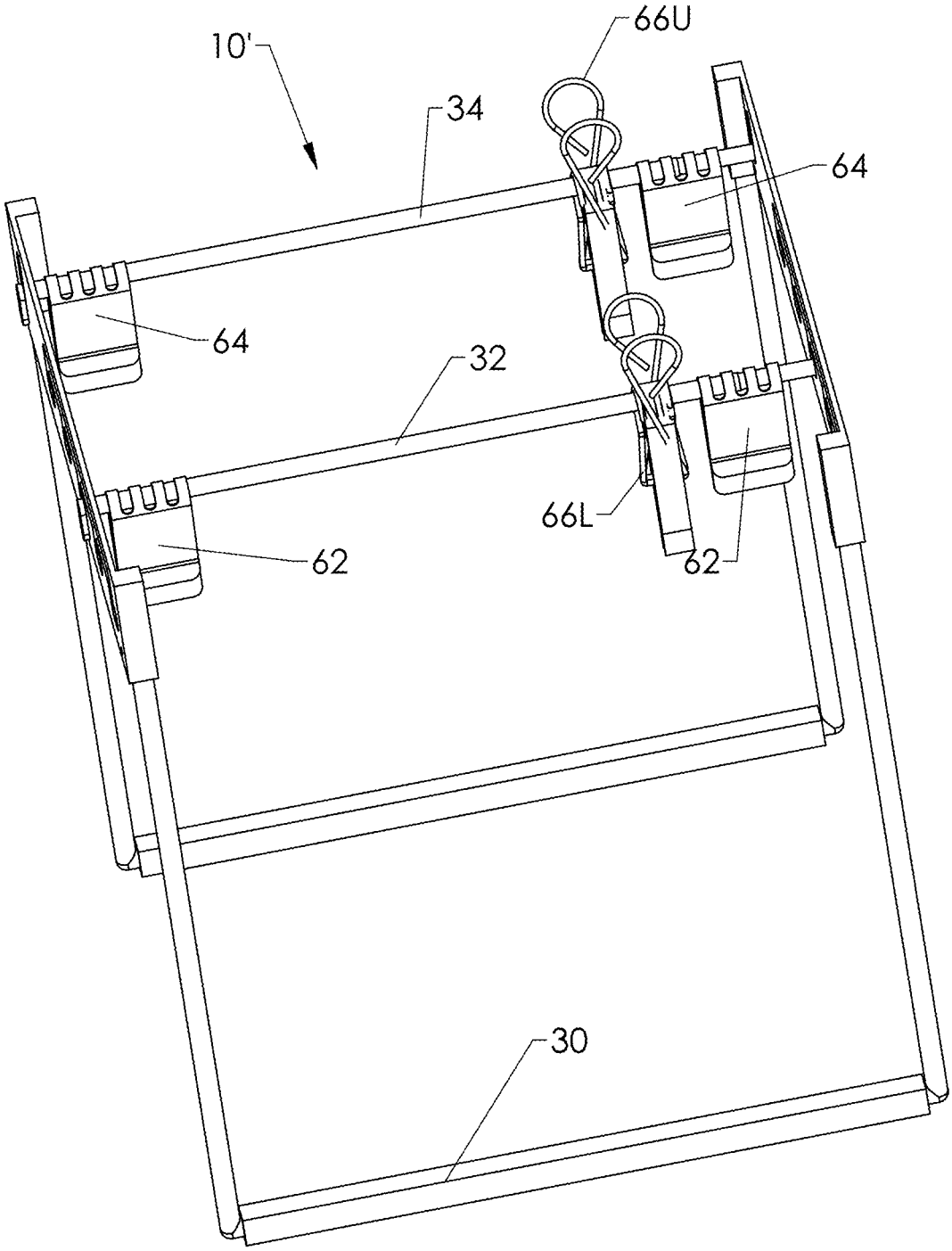
FIG. 8 is a top front perspective view of the embodiment of FIG. 7, with the bag removed.

FIGS. 7 and 8 show holder 10' comprising an additional clip 66, also called a "spring clip", on each of the crossbars 32, 34, which may be a clip style more easily used by many people. FIG. 7 shows the holder 10' in use with bag 51, wherein the holder comprises both clip styles (62, 64 and 66), but only clips 66 are being used to capture the bag. A single clip 66 may be used on each crossbar, as shown in FIGS. 7 and 8, when a bag such as that shown in FIG. 7 is small enough and/or the bag walls are firm/rigid enough that one clip per crossbar is sufficient to hold up and hold open the bag before and during loading of goods into the bag. In alternative embodiments, multiple clips 66 may be provided on each crossbar, supplementing or entirely replacing clips 62, 64.

Clips 66 are available commercially and will be understood from FIGS. 7 and 8 to each comprise two halves that are pivotal relative to each other and spring-biased to force the lower ends 66L together. Pinching/pressing together upper clip ends 66U acts against the bias to separate the lower clip ends 66L, for convenient insertion of the top edges 52, 54 into the clips 66, followed by releasing the upper clip ends 66U to allow the lower ends 66L to move back together to capture the top edges. These clips 66 may be used in addition to clips 62, 64, if desired. Clips 66 are preferably slidable along the entire or substantially the entire lengths of their respective crossbars, and rotatable at least 90 degrees, more preferably at least 120 degrees, and most preferably at least 180 degrees, around their respective crossbars.

Alternative Embodiment with Open Adjustment Slots and Alternative Fasteners

Figure 9:
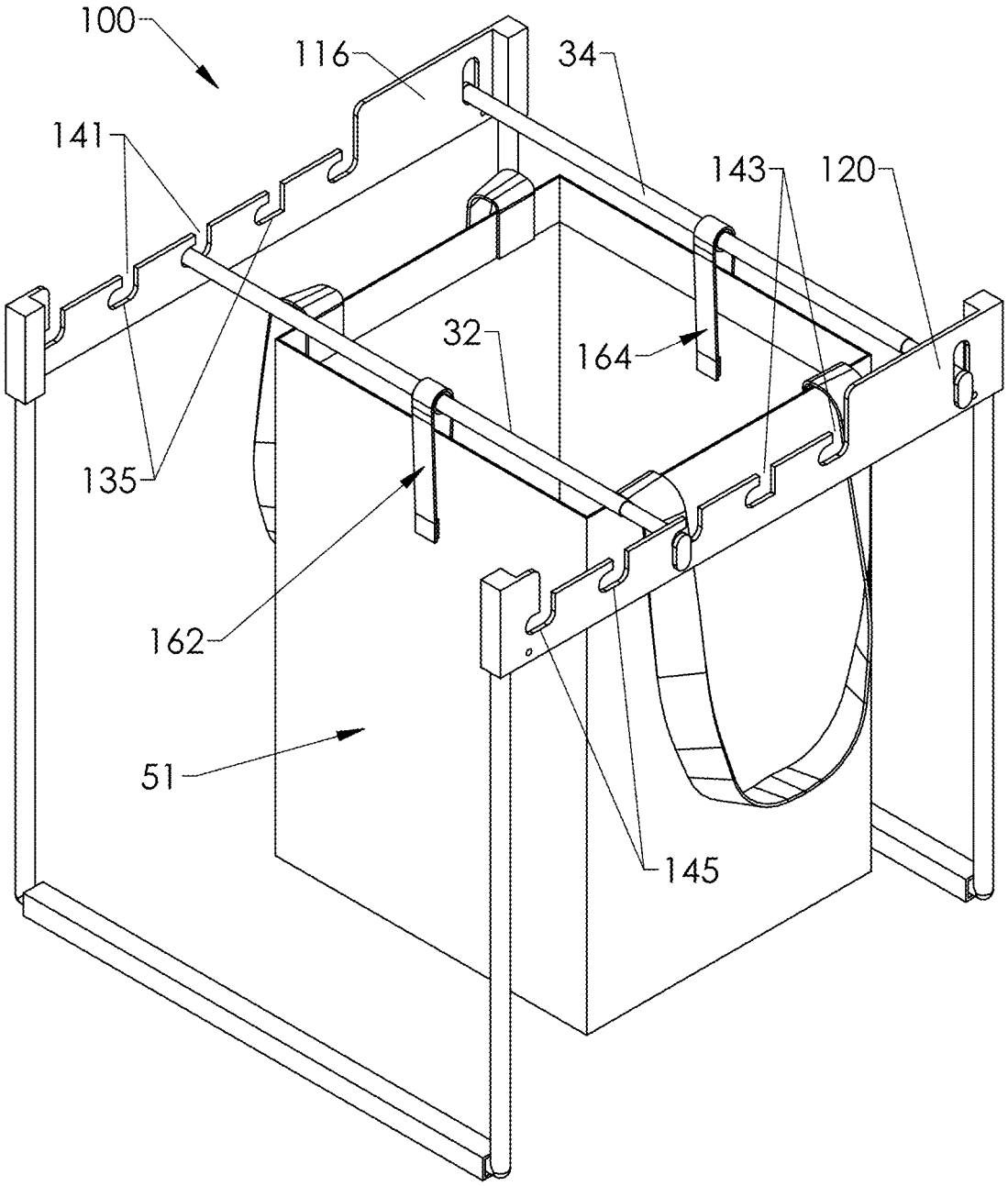
FIG. 9 is a top front perspective view of an alternative holder embodiment with open adjustment slots and alternative fasteners connected to and supporting an open bag.
Figure 10:
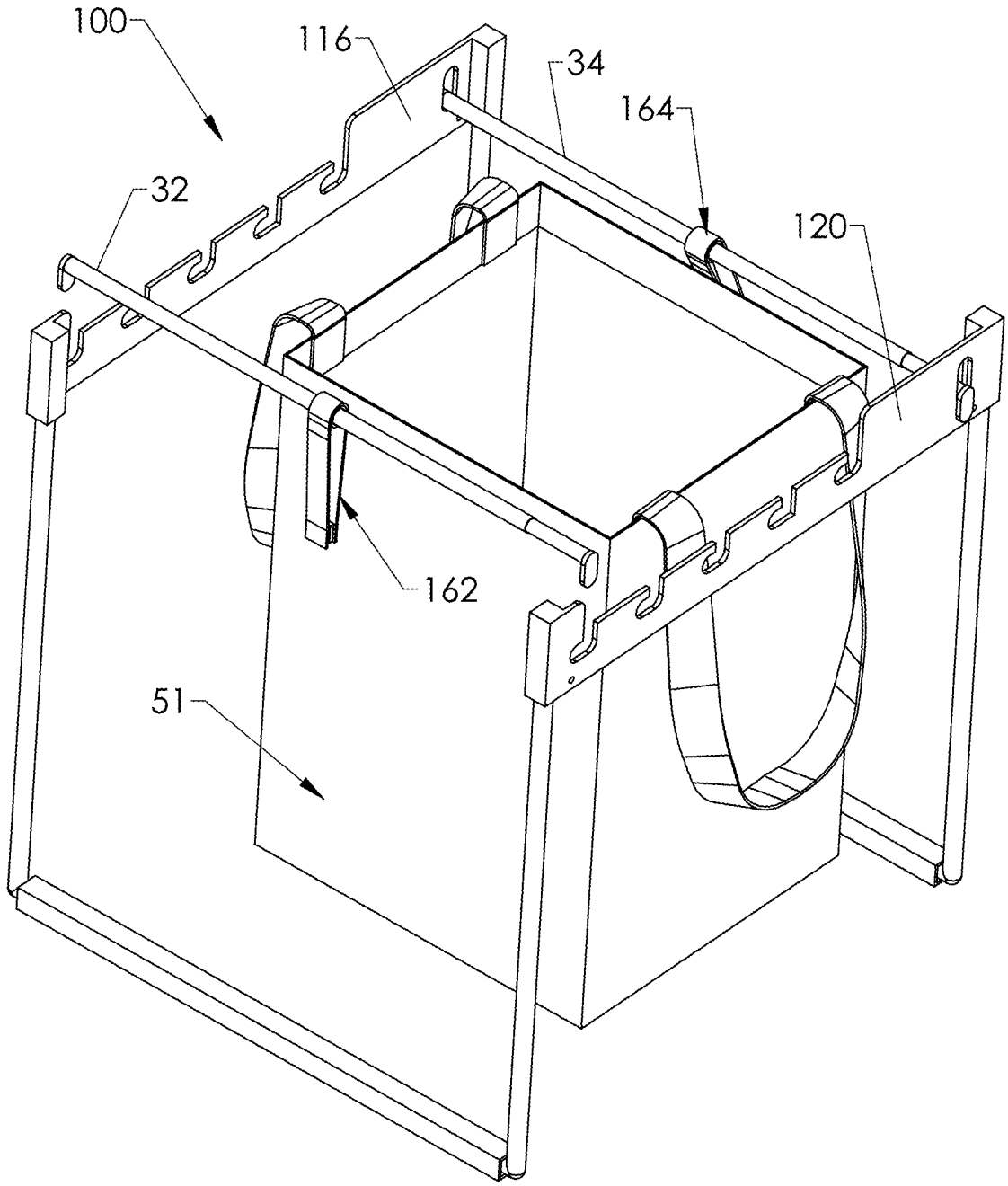
FIG. 10 is a top front perspective view of the holder of FIG. 9, wherein the fasteners have been disconnected from the bag and the front crossbar has been lifted up and then forward, illustrating how the front crossbar may be removed for easy access to a loaded bag.
Figure 11:
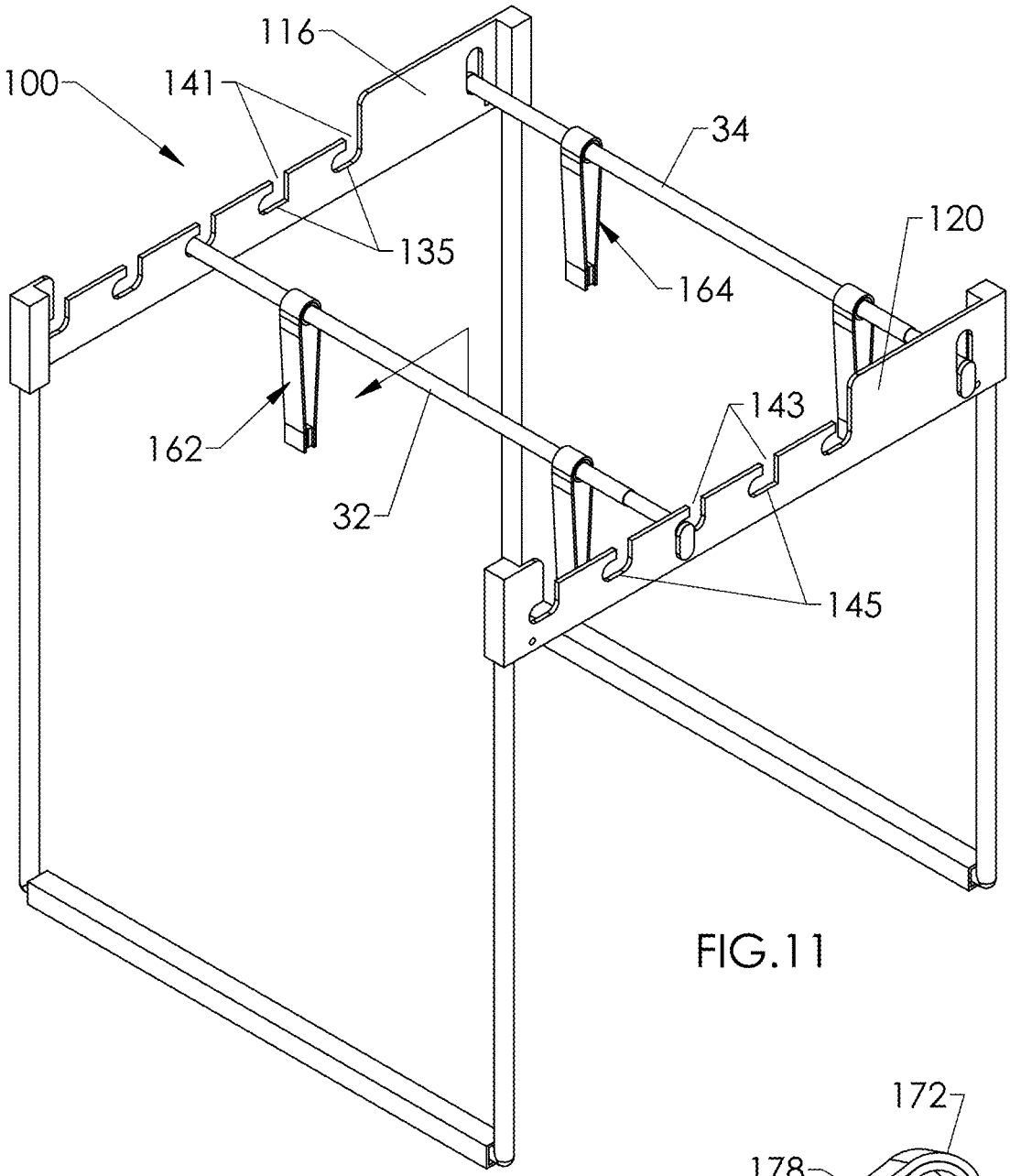
FIG. 11 is a top front perspective view of the holder of FIGS. 9 and 10, with additional fasteners installed on the crossbars.

FIGS. 9-12 portray an alternative holder 100 that features modified left and right brackets 116, 120 and alternative fasteners 162, 164. Holder 100 may be seen in FIG. 9 to operate for bag capture and support in much the same way as holders 10, 10'. It should be noted that one front fastener 162 and one rear fastener 164 are shown in use in FIG. 9, but many embodiments will use multiple front fasteners 162 and multiple rear fasteners 164 as shown in FIG. 11, to capture at least the right and left front corners and at least the right and left rear corners of the open bag perimeter.

The modified brackets 116, 120 comprise notches 135, 145 with upper openings 141, 143 from which the front crossbar 32 may be raised and removed from the frame (FIG. 10). In other words, there is no horizontal bar or other bracket or frame portion/structure (for example, no portion 16B or 20B of FIGS. 3 and 4) that prevents a user from lifting the front crossbar 32 straight up and away from the frame. The modified brackets 116, 120 result in crossbar 32 not needing to be moved horizontally, or telescoped horizontally, to remove the two ends 32E of the crossbar 32 from the brackets 116, 120. As shown in FIG. 10, the front crossbar has been detached from the bag 51 by disengaging the magnetic fastener(s) 162 from the bag 51, and the front crossbar has been lifted up out of the bracket notches (135, 145) and away from the bag 51. With the bag 51 detached from fastener(s) 162 and therefore from the crossbar 32, the front crossbar may be held or set aside while the bag is removed from the frame/interior space. FIG. 10 also shows that the rear fastener, portrayed as a magnetic fastener that is the same as front fastener 162, has been disconnected from the bag 52 to free the bag; the disconnection of the rear fastener(s) may be done before or after removal of the front crossbar. Removal of the crossbar 32 may be particularly important if bag 51 is full of goods and/or is bulging or otherwise difficult to handle due to the goods. Such removal of the front crossbar may be particularly helpful to expedite the user's lifting and/or pulling-forward the bag in order to remove it from the frame to carry away the full bag.

It may be noted that this easily liftable and removable crossbar system may also assist a user to install an empty bag in the holder, as the bag may be set inside the frame/interior space with the front crossbar 32 set aside or held to the side so the crossbar is not in place or connected/attached to the frame. This gives the user a lot of room for bag insertion and for bag 51 to be connected to the rear crossbar 34. Then, the user may set the front crossbar 32 down into the selected upper openings 141, 143 of the brackets 116, 120, to place the crossbar ends in the desired notches 135, 145 for connection of the bag by another one or more clips/fasteners to crossbar 32.

Figure 12:
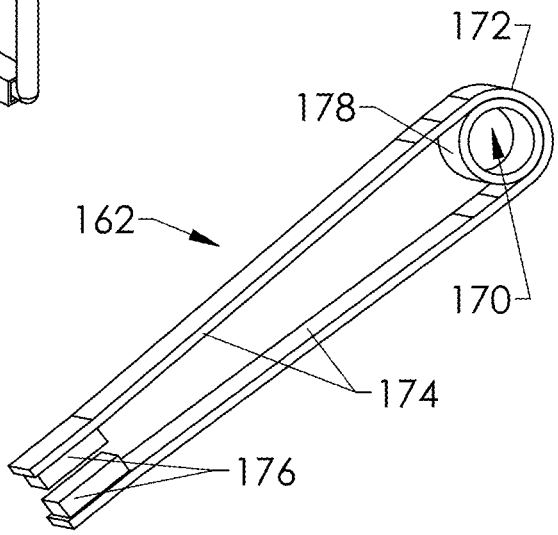
FIG. 12 is an enlarged perspective view of a fastener of the holder of FIGS. 9-11.

The bag fasteners 162, 164 shown in FIGS. 9-12 are an example of another fastener embodiment that may be used to clasp/clamp the bag to temporarily connect the bag to the holder 100. As seen in FIG. 11, multiple of the magnetic fasteners may be used on each of the front and rear crossbars, for capturing the front and rear corners of the open bag perimeter. As seen in the enlargement of FIG. 12, certain embodiments of the magnetic fasteners 162, 164 have a connection 170 at one end 172 of the fastener that is adapted to circle or otherwise connect to the crossbar 32, 34. The elongated, flexible straps 174 extend at least several inches to meet at their distal ends where a magnet 176 is provided on each of the two distal ends so those magnets are strongly attracted to each other. This way, a magnet 176 may be placed on each of the two sides of a wall of the bag, and the two magnets tend to "snap together" to hold or clamp the bag wall between the attracted magnets 176 (FIG. 9). The straps 174 are flexible and are easy to grasp for pulling the magnets 176 apart to free the bag wall, after which the straps 174 tend to fall back toward each other to magnetically connect again as in FIGS. 10 and 11.

Enlarged FIG. 12 shows the two magnets slightly separated, so the viewer can see the fastener 163, 164 to better advantage. In certain embodiments, the connection 170 to the crossbar(s) may be a rigid, circular ring 178 or other element/portion that slidably connects to the crossbar 32, 34, so that the connection 170 may receive a respective crossbar 32, 34, be longitudinally slidable and preferably rotatable on the crossbar, and preferably be prevented from falling off the crossbar, for example, until the user purposely disassembles the holder 100.

Referring More Specifically to Method of Use

In certain embodiments, the method of using holder 10, 10' is to: Step 1) adjust the interior space IS to be the same or slightly greater in depth, and in certain embodiments the same or greater in width, than the bag when empty; and Step 2) lower bag vertically down to insert the bag through the interior space IS top opening TO (FIG. 4) between the left and right sides of the holder 10, 10' and between the front and rear crossbars 32, 34, wherein Steps 1 and 2 may be switched in order whereby the frame adjustment may be done after the bag is inserted. Step 3) is capturing the bag top perimeter with clips/fasteners, and Step 4) is loading the bag with goods (G in FIG. 1) only to an extent that does not pull the bag away from the clips/fasteners to unclip/disconnect the bag, and does not push the bag sides out through the left side opening LO, right side opening RO, front opening FO, or rear opening BO. Step 5) is disconnecting the clips/fasteners from the bag. Step 6) is lifting the loaded bag, in reverse of Step 2, vertically upward from the holder through the top opening TO, so that the bag "clears" the holder during Steps 2 and 6, without readjusting or disassembling the holder or its frame and without significant jostling or struggling with the bag, and preferably with the only handling of the bag being to grasp the handles and lifting the bag. Less preferably, should the user need to push a wall of the bag inward slightly to lift the bag up from the holder, the open left, right, and front sides, and the optional open rear side, of the holder's frame give access to the outer walls of the bag to do so.

As described above regarding holder 100, an adaptation to allow the front crossbar 32 to be easily removed from the frame may allow the user to remove the obstacle that the crossbar 32 may present for removal of a full bag. This way, the bag 51 of FIGS. 9 and 10, once the crossbar 32 is removed, may be pulled up and/or forward out of the frame with little or no trouble.

Therefore, the interior space IS, via its top opening TO, allows the shopping bag to entirely or substantially "clear" the holder's frame during the above embodiments of the method of use. However, it will be understood that an important factor for the use of the holder 10, 10' is adjustment of interior space IS to fit the depth of the bag 50, 51, so that the clips or other fasteners effectively reach and grasp the upper edge of the bag in a way that keeps the bag open and stable in the holder. Certain embodiments of the depth adjustment make the interior space up to 20 percent, or more preferably up to 15 percent, greater than the depth of the bag, which may be important for creating a small amount of room between the bag and the frame for easier full-bag removal. Certain embodiments of width adjustment make the interior space up to 20 percent greater than the width of the bag, or greater in certain embodiments, depending on the user's preference and on the size of the bagging surface.

From the description herein and the drawings, it will be understood that the interior space IS of the holder, and the holder's frame, is defined as: the space that extends between the left side and right side of the frame (more specifically between the right surface of members 14 and the left surface of members 18, and between the right surface of bracket 16 and the right surface of bracket 20); and extends between the front crossbar 32 and the rear crossbar 34 (more specifically, between parallel vertical planes extending through the rear surface of the front cross-bar 32 and the front surface of the rear crossbar 34. Also, it will be understood from the description in this document and from FIGS. 3-5, that the top opening TO into the interior space IS (FIG. 4)) varies in its front-to-rear depth dimension depending on adjustment of crossbar 32 and varies in its width left-to-right width dimension depending on width adjustment of the frame, as described in this document.

Certain Embodiments Summarized

Certain embodiments of the invented holder apparatus and/or the invented methods of using the apparatus may be described as comprising a rectangular frame, wherein the frame, and/or bag-holding elements provided on the frame, are, adjustable in adjustable in depth and/or in width. The adjustability may be done by telescoping elements and/or bag-support bars being slidable and retainable in various positions to accommodate/fit various bag sizes. The frame may comprise, consist of, or consist essentially of, right and left sides connected by bottom rung portions that rest on a bagging surface near a check-out table/counter, and bars that extend between the right and left sides at or near the top of the frame and that are adapted to capture, hold-up and hold-open a bag positioned inside an interior space of the frame. Said bars may be called crossbars, for example, a first crossbar and a second crossbar, or, in certain embodiments the front crossbar and the rear crossbar. The adaptation to capture, hold-up, and hold-open the bag, in certain embodiments, includes the holder comprising clips that connect a top perimeter/edge of the bag to the bars. The right and left side may move apart or closer-together to adjust the width of the frame and the interior space, and said bars are moveable apart or closer-together to adjust the depth of the interior space and, hence, the effective depth of the holder and its frame. While lockable height adjustment may be provided in certain embodiments, for simplicity and to ensure the holder and its frame height cannot collapse, it is preferred in many embodiments that the holder and its frame not be adjustable in height. The non-height-adjustable holder and its frame are preferably in the range of 12-20 inches tall, as that will accommodate most or all grocery and retail bags.

The holder may be made of various durable and strong materials. Stainless steel or other non-tarnishing metals are preferred, especially for environments where cleaning with chemical cleaners or disinfectants is frequently done.

Although this disclosed technology has been described above with reference to particular means, materials, and embodiments, the invented technology is not limited to these disclosed particulars but extends instead to all equivalents of apparatus and of methods of using the apparatus within the broad scope of this disclosure and the following claims.

The invention claimed is:

1. A holder for holding a shopping bag in an open condition for loading goods into the bag through a bag opening, the holder comprising a frame and fasteners for connection to the bag, wherein:

the frame has a left side, right side, front side, a rear side, a bottom side for resting on a bagging surface, and a top side having a first crossbar and a second crossbar for connecting to and supporting a perimeter of the bag opening, the frame having an interior space with a width extending between the left side and right side, a height extending between the bottom side and the top side, and a front-to-back depth extending horizontally between the first crossbar and the second crossbar, wherein the first crossbar is movable toward and away from the second crossbar to change the depth of the interior space; and said fasteners are slidably connected to the first crossbar and second crossbar for detachable connection to said perimeter of the bag opening, wherein at least one of the fasteners is movable on the first crossbar between the left side and the right side, and at least one of the fasteners is moveable on the second crossbar between the left side and the right side to capture front and rear corners of the perimeter of the bag opening;

wherein said frame comprises left and right horizontal slots in upper end brackets of the left side and the right side, respectively, and the first crossbar is movable toward and away from the second crossbar by sliding horizontally rearward and forward, respectively, in the horizontal slots; and wherein each of said horizontal slots has downwardly extending notches that receive ends of the first crossbar to retain the first crossbar at a selected distance from the second crossbar.

2. The holder as in claim 1, wherein said bottom side comprises rungs that are connected to bottom ends of the left side and the right side and that telescope to move the left side and the right side toward and away from each other to adjust the width of the interior space.

3. The holder as in claim 1, wherein said fasteners are clips that are rotatable on the crossbars.

4. The holder as in claim 1, wherein the first crossbar has ends that extend down along an outer surface of the brackets when the first crossbar is installed in the brackets.

5. The holder as in claim 1, wherein the first crossbar is removable from said horizontal slots for separation from the frame.

6. The holder as in claim 2, wherein said frame has a left opening in the left side between the rungs connected to the bottom end of the left side and the upper end bracket of the left side, for accessing a bag in the interior space through the left opening.

7. The holder as in claim 6, wherein said frame further has a right opening in the right side between the rungs connected to the bottom end of the right side and the upper end bracket of the right side, for accessing the bag in the interior space through the right opening.

8. A holder for holding a shopping bag in an open condition for loading goods into the bag through a bag opening, the holder comprising a frame and fasteners for connection to the bag, wherein:

the frame has a left side, right side, front side, a rear side, a bottom side for resting on a bagging surface, and a top side having a first crossbar and a second crossbar for connecting to and supporting a perimeter of the bag opening, the frame having an interior space with a width extending between the left side and right side, a height extending between the bottom side and the top side, and a front-to-back depth extending horizontally between the first crossbar and the second crossbar, wherein the first crossbar is movable toward and away from the second crossbar to change the depth of the interior space; and said fasteners are slidably connected to the first crossbar and second crossbar for detachable connection to said perimeter of the bag opening, wherein at least one of the fasteners is movable on the first crossbar between the left side and the right side, and at least one of the fasteners is moveable on the second crossbar between the left side and the right side to capture front and rear corners of the perimeter of the bag opening;

wherein said bottom side comprises rungs that are connected to bottom ends of the left side and the right side;

wherein one of said rungs is a front rung at the front side of the frame, and wherein the frame further has a front opening in the front side between the front rung and the first crossbar, for accessing the bag through the front opening.

9. An adjustable holder for holding shopping bags of different left-to-right widths and different front-to-rear depths in an open condition in an interior space of the holder, for loading of the bag with objects, the holder comprising a frame and a plurality of fasteners connected to the frame, wherein said frame comprises:

horizontal front and rear bottom rungs for resting on a surface, left and right sides upending from left ends and right ends of the bottom rungs, respectively, wherein each of the left and right sides has a top end, wherein the frame has a width between the left and right sides, and the left and right sides are movable toward and away each other for decreasing and increasing the interior space width, respectively;

a left bracket connected to the top end of the left side and a right bracket connected to the top end of the right side, each of the left and right brackets having a horizontal slot;

a rear crossbar and a front crossbar each extending between the left bracket and the right bracket, wherein the interior space has a depth between the rear crossbar and the front crossbar, and the front crossbar has left and right ends received and horizontally-slidable in the horizontal slots of the left and right brackets, so that the front crossbar is slidable toward and away from the rear crossbar to decrease and increase the interior space depth, respectively; and wherein said plurality of fasteners comprises at least one fastener on each of the rear crossbar and the front crossbar, for detachably connecting a top perimeter of the shopping bag to the rear and front crossbars when the front crossbar is a distance from the rear crossbar for holding the bag in the open condition.

10. The holder of claim 9, wherein each horizontal slot has downward-extending notches spaced from a front end of the horizontal slot to a rear end of the horizontal slot, for incremental adjustment of the front crossbar distance from the rear crossbar by the left and right ends of the crossbars dropping down into selected notches to be retained in the selected notches.

11. The holder of claim 9, wherein said at least one fastener on each of the rear crossbar and the front crossbar comprise two fasteners on the front crossbar and two fasteners on the rear crossbar.

12. The holder of claim 11, wherein said two fasteners on the front crossbar are resilient clips biased to a closed position for grasping the perimeter of the bag and said two fasteners on the rear crossbar are resilient clips biased to a closed potion for grasping the perimeter of the bag.

13. The holder of claim 11, wherein the left side comprises front and rear vertical side members that are spaced apart, so the left side is substantially open for reaching through the left side into the interior space.

14. The holder of claim 13, wherein said right side comprises front and rear vertical side members that are spaced apart, so the right side is substantially open for reaching through the right side into the interior space.

15. The holder of claim 14, wherein the horizontal front bottom rung extends only between bottom ends of the left and right sides so that above the horizontal front bottom rung is a front opening into the interior space for reaching the bag.

16. The holder of claim 15, wherein said frame has a frame top opening between the left and right sides and between the front and rear crossbar for receiving the bag and for the bag to be lifted up through the frame top opening upon the bag being filled.

17. The holder of claim 16, wherein the two fasteners on the front crossbar are slidable left and right on the front crossbar.

18. The holder of claim 17, wherein the two fasteners on the rear crossbar are slidable left and right on the rear crossbar.

19. A combination of an adjustable holder and a shopping bag received in the holder in an open condition for filling the bag with goods, wherein the holder comprises a frame, wherein:

said frame has a left side, right side, front side, a rear side, a bottom side for resting on a bagging surface, and a top side comprising a first crossbar and a second crossbar that connect top ends of the left and right sides;

said frame has an interior space having a width extending between the left side and right side, a height extending between the bottom side and the top side, and a front-to-back depth extending horizontally between the first crossbar and the second crossbar, wherein the first crossbar is movable toward and away from the second crossbar to change the depth of the interior space; and wherein the holder further comprises fasteners that are connected to the first crossbar and second crossbar and that detachably connect to, and support, a perimeter of the bag extending around the opening of the bag; and wherein at least one of the fasteners is moveable on the first crossbar between said left side and said right side to connect to front, left and right corners of said perimeter, and at least one of the fasteners is moveable on the second crossbar between said left side and said right side to connect to rear, left and right corners of said perimeter;

wherein the bottom side of the frame comprises rungs that connect bottom ends of the left side and the right side, wherein the rungs, the first crossbar, and the second crossbar telescope to move the left side and the right side toward and away from each other to adjust the width of the interior space.

20. The holder of claim 8, wherein the first crossbar has ends that extend down along an outer surface of the brackets when the first crossbar is installed in the brackets.

21. The holder of claim 8, wherein the first crossbar is removable from said horizontal slots for separation from the frame.

22. The holder of claim 9, wherein the front crossbar has ends that extend down along an outer surface of the brackets when the front crossbar is installed in the brackets.

23. The holder of claim 9, wherein the front crossbar is removable from said horizontal slots for separation from the frame.

24. The holder of claim 19, wherein the first crossbar has ends that extend down along an outer surface of the brackets when the first crossbar is installed in the brackets.

25. The holder of claim 19, wherein the first crossbar is removable from said horizontal slots for separation from the frame.

* * * * *